US007490925B2

(12) United States Patent
Lewey et al.

(10) Patent No.: US 7,490,925 B2
(45) Date of Patent: Feb. 17, 2009

(54) FREE FLOW FLUID DELIVERY SYSTEM FOR PRINTING DEVICE

(75) Inventors: William E Lewey, Corvallis, OR (US); Ralph L. Stathem, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 415 days.

(21) Appl. No.: 11/261,679

(22) Filed: Oct. 28, 2005

(65) Prior Publication Data

US 2007/0097184 A1 May 3, 2007

(51) Int. Cl.
*B41J 2/17* (2006.01)
*B41J 2/18* (2006.01)
*B41J 2/19* (2006.01)

(52) U.S. Cl. ..... 347/84; 347/89; 347/92

(58) Field of Classification Search ..... 347/84, 347/89, 92

See application file for complete search history.

(56) References Cited

U.S. PATENT DOCUMENTS 5,341,162 A 8/1994 Hermanson et al.
6,082,851 A * 7/2000 Shihoh et al. ..... 347/85
6,158,836 A * 12/2000 Iwasaki et al. ..... 347/15
6,206,146 B1 3/2001 Pawlowski, Jr. et al.
6,533,403 B2 3/2003 Hou et al.

FOREIGN PATENT DOCUMENTS

EP 0916502 5/1999
EP 1243310 9/2002
EP 1359026 11/2003
WO 96/11385 4/1996

OTHER PUBLICATIONS

International Search Report for Application No. PCT/US2006/029376. Report issued Jan. 16, 2007.
U.S. Office Action dated Feb. 25, 2008 for co-pending, U.S. Appl. No. 11/261,680.

* cited by examiner

*Primary Examiner*—Julian D Huffman
*Assistant Examiner*—Jason S Uhlenhake

(57) ABSTRACT

Methods are provided for use in a printing device. One method includes allowing a printing fluid to flow from a fluid supply container to a fluid reservoir of a printhead assembly, then urging material from at least the fluid reservoir and the fluid supply container to a separating container, then preventing any further amount of the printing fluid from flowing from the fluid supply container while continuing to urge the material from at least the fluid reservoir to the separating container, then stopping the urging of the material from at least the fluid reservoir to the separating container, and then allowing the printing fluid to flow from the fluid supply container to the fluid reservoir.

8 Claims, 5 Drawing Sheets

FREE FLOW FLUID DELIVERY SYSTEM FOR PRINTING DEVICE

RELATED PATENT APPLICATIONS

This patent application is related to U.S. patent application Ser. No. 11/262,169, titled "Printing Fluid Control In Printing Device", filed Oct. 28, 2005.

This patent application is related to U.S. patent application Ser. No. 11/261,681, titled "Fluid Delivery System For Printing Device", filed Oct. 28, 2005.

This patent application is related to U.S. patent application Ser. No. 11/261,680, titled "Free Flow Fluid Delivery System For Printing Device", filed Oct. 28, 2005.

BACKGROUND

Some printing devices include a printhead or pen that is configured to controllably direct drops of ink(s) or other like printing fluid(s) towards a sheet of paper or other like print medium. The inks or printing fluids are typically supplied by to the printhead by a fluid delivery system. Some fluid delivery systems are located "on-axis" with the printhead while others also include "off-axis" components. The fluid delivery system may include, for example, one or more containers that act as reservoirs to supply the fluids to the printhead through one or more fluidic channels.

In certain printing devices, the fluid delivery system is configured to maintain a backpressure force on the printing fluid so as to prevent the printing fluid from simply draining out through the ejection nozzles of the printhead. Accordingly, as the printing fluid is ejected during printing the fluid delivery system is usually configured to adapt to the reduced volume of printing fluid in some manner so as to maintain the backpressure force within applicable limits. For example, some fluid delivery systems include foam or other like capillary members within an on-axis container. The foam acts like a sponge in holding the printing fluid while also allowing the fluid to be used for printing. The capillary action of the foam provides the backpressure force. As the printing fluid is consumed air is allowed to enter into the container and into the foam.

In other exemplary printing devices, the printing fluid is delivered from on-axis and/or off-axis containers that do not include foam. Some of these containers include a bag-accumulator arrangement or the like that provides the desired backpressure force. Some of these containers include a bubbler feature that is configured to allow air to bubble into the container through the printing fluid to maintain the desired backpressure force. Some off-axis implementations also include additional containers adjacent the printhead.

In some implementations, a pump may also be provided to move the printing fluid in one or both directions between the container and the printhead.

Bubbling air through the printing fluid may cause significant foaming or froth development. Bidirectional pumping may spread such froth within the system.

There is a need for cost efficient methods and apparatuses that can control the flow of printing fluid between the container and the printhead without increasing the development and/or spreading of froth.

BRIEF DESCRIPTION OF THE DRAWINGS

The following detailed description refers to the accompanying figures.

DETAILED DESCRIPTION

Figure 1:
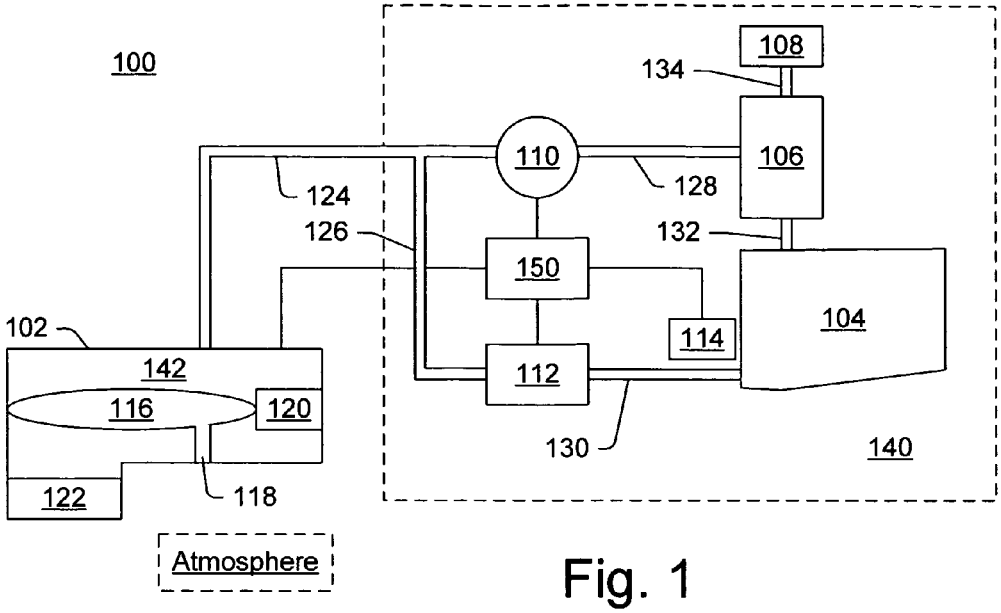
FIG. 1 is a block diagram illustrating certain features of a printing device including a free flow fluid delivery system having a unidirectional pump coupled to a froth separating container, and a valve in a by pass position coupled to a printing supply container, in accordance with certain exemplary implementations.

FIG. 1 is a block diagram depicting an exemplary printing device 100 that includes a printhead assembly 102 coupled to a fluid delivery system 140, in accordance with certain embodiments. Printing device 100 may print with a plurality of printing fluids, however, for the sake of brevity in this description for FIGS. 1-4 only one printing fluid and corresponding fluid delivery system is illustrated.

Fluid delivery system 140 includes a fluid supply container 104, a separating container 106, a double bubbler 108, a pump 110, a valve 112, an out of fluid sensor 114, various interconnecting fluid passageways 124, 126, 128, 130, 132, and 134, and a controller 150.

Here, double bubbler 108 is fluidically coupled to separating container 106 by fluid passageway 134. Double bubbler 108 is configured to regulate gas pressure within fluid delivery system 140. In this example, double bubbler 108 is bidirectional in that it is configured to allow gas from separating container 106 to escape into the atmosphere and to allow gas from the atmosphere to enter into separating container 106 based on a pressure difference between the gas in the container and gas in the atmosphere. Thus, for example, when the absolute value or magnitude of the pressure difference reaches a threshold level then double bubbler 108 will permit gas to enter or exit separating container 106, flowing or bubbling from the higher pressure side to the lower pressure side through a wetted feature. Exemplary double bubbler methods and apparatuses are presented in more detail in the related patent application titled "Fluid Delivery System For Printing Device", which is incorporated, in its entirely, by reference herein.

Separating container 106 is fluidically coupled to pump 110 through fluid passageway 128, and to fluid supply container 104 through fluid passageway 132. Separating container 106 is configured to receive material (e.g., fluid, gas and/or froth) from fluid passageway 128. Received froth is allowed to separate into fluid and gas portions while inside separating container 106. Gas inside separating container 106 is able to move through fluid passageway 134 to/from double bubbler 108. Fluid inside separating container 106 is able to move through fluid passageway 132 and into fluid supply container 104. In certain other implementations, fluid supply container 104 may also function as the separating container. The printing fluid inside fluid supply container may be in free volume form.

Fluid supply container 104 is fluidically coupled to valve 112 through fluid passageway 130. In this example, out of fluid sensor 114 is operatively configured to sense or otherwise detect the presence of a gas or a froth (e.g., mixture of gas and fluid) in fluid passageway 130. Out of fluid sensor 114 is operatively coupled to controller 150. Controller 150 may include, for example, logic and memory configured to monitor and control certain operations of printing device 100. The hardware for such controllers and sensors is well known.

Valve 112 is fluidically coupled to fluid passageway 130 and fluid passageway 126. Valve 112 is a controllable valve that can be set in an open state or a shut state. In the open state, valve 112 fluidically couples fluid passageways 130 and 126 together. Conversely, in the shut state, valve 112 fluidically uncouples fluid passageways 130 and 126. The setting of valve 112 may be accomplished by electrical signals from controller 150. Fluid passageway 126 is fluidically coupled to fluid passageway 124. Fluid passageway 124 is essentially shared by pump 110 and valve 112.

Pump 110 can be selectively started or stopped, for example, by electrical signals from controller 150. Once started, pump 110 moves fluid, gas and/or froth from fluid passageway 124 to fluid passageway 128. Once stopped, no fluid, gas and/or froth is allowed to move from fluid passageway 124 to fluid passageway 128. In this example, pump 110 is unidirectional. In certain implementations, for example, pump 110 is a peristaltic pump.

Printhead assembly 102 includes a printhead 122 having a plurality of fluid ejecting nozzles (not shown), a fluid reservoir 142 within which is arranged a accumulator mechanism having an inflatable bag 116 biased to deflate by resilient member 120. Inflatable bag 116 is pressurized by atmospheric gas through a vent 118. Fluid reservoir 142 is fluidically coupled to at least a portion of the nozzles printhead 122 and to fluid passageway 124. The accumulator mechanism is configured to provide a sufficient backpressure within fluid reservoir 142 to prevent printing fluid from leaking out through the nozzles.

During printing, valve 112 is open and pump 110 is stopped. Thus, printing fluid can be urged to flow from fluid supply container 104 through fluid passageway 130, valve 112, fluid passageway 126, fluid passageway 124, and into fluid reservoir 142 as a result of the ejection of fluid by printhead 122. As the printing fluid flows from fluid supply container, gas from the atmosphere is allowed to enter into fluid delivery system 140 by double bubbler 108. When printing is completed, valve 112 can be shut.

During certain maintenance operations, pump 110 and valve 112 can be controlled to allow fluid, gas and/or froth to be moved about within fluid delivery system 140.

Figure 2:
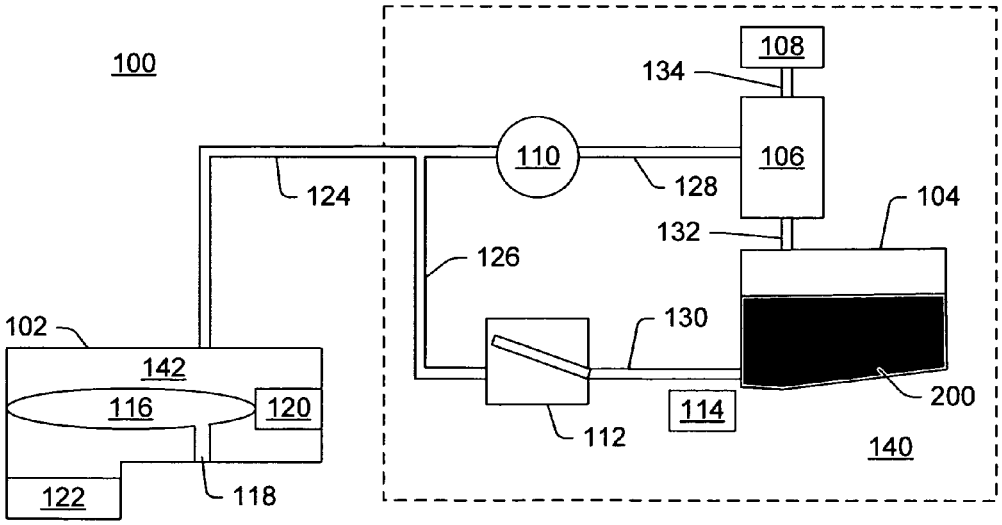
FIG. 2 is a block diagram illustrating certain features of the printing device of FIG. 1 with a printing fluid available for use in the printing supply container, in accordance with certain exemplary implementations.

Reference is made next to FIG. 2, which is similar to FIG. 1. Here, a printing fluid 200 is shown within fluid supply container 104; however valve 112 is in a shut state so printing fluid 200 is prevented from flowing towards printhead assembly 102.

Figure 3:
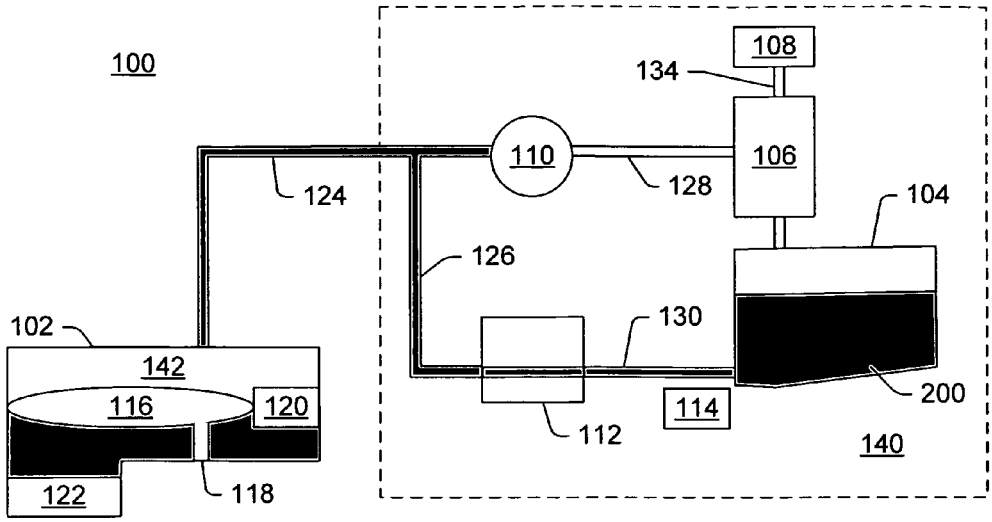
FIG. 3 is a block diagram illustrating certain features of the printing device of FIG. 2 with the printing fluid available for use in printing, in accordance with certain exemplary implementations.

In FIG. 3, which is similar to FIG. 2, printing fluid 200 is illustrated as having been urged to move through portions of fluid delivery system 140 to fill the printhead assembly 102 for printing. Here, valve 112 is in an open state and some of printing fluid 200 has moved into fluid passageways 130, 126 and 124, and into fluid reservoir 142. As shown here, printing device 100 is ready to print.

Figure 4:
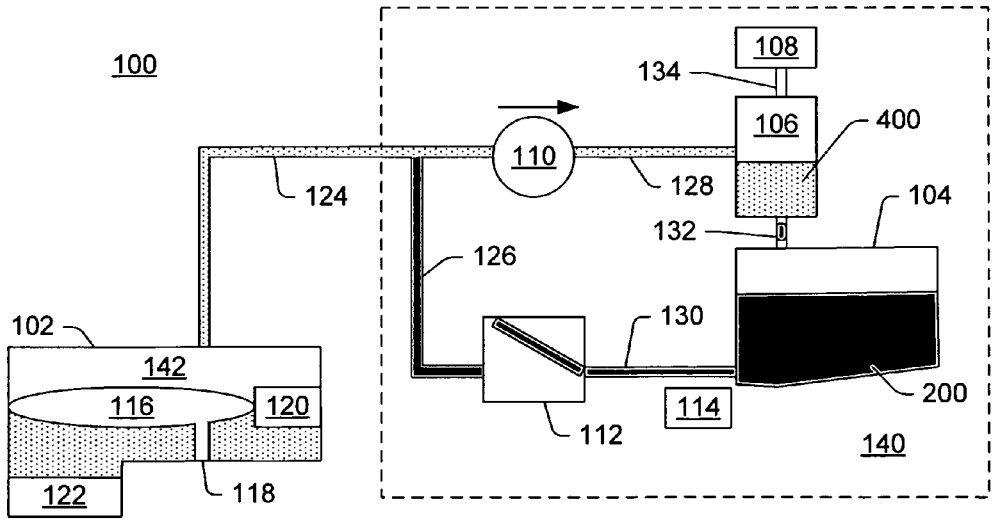
FIG. 4 is a block diagram illustrating certain features of the printing device of FIG. 3 during an air management maintenance operation to remove at least a portion of fluid, gas and/or froth in the fluid delivery system and printhead assembly, in accordance with certain exemplary implementations.

In FIG. 4, which is similar to FIG. 3, valve 112 is in a shut state. A froth 400 is illustrated within fluid reservoir 142, fluid passageways 124 and 128, (and possibly 126), and separating container 106. Here, pump 110 has been started and is urging fluid, gas and/or froth 400 towards separating container 106. Inflatable bag 116 will fill with air from vent 118 as the pressure changes during pumping. Gas within separating container 106 may exit the system through double bubbler 108 during this pumping process. When pump 110 is stopped and valve 112 set to an open state, then printing device 100 will eventually appear as shown in FIG. 3 with printing fluid 200 having being drawn from fluid supply container 104 to fluid reservoir 142 due to the accumulator mechanism in the printhead assembly 102.

Figure 5:
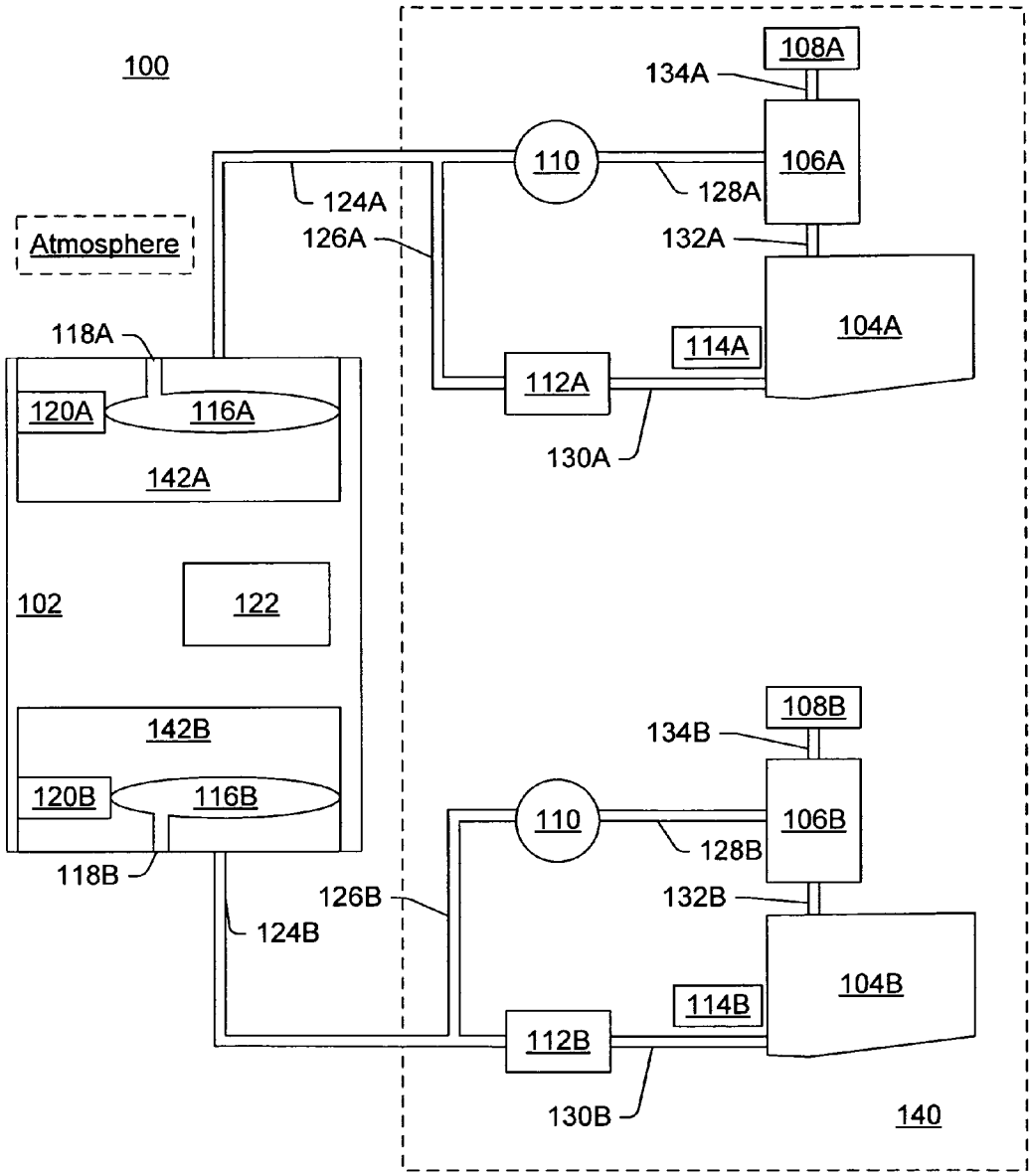
FIG. 5 is a block diagram illustrating certain features of a printing device including a free flow fluid delivery system having a unidirectional pump coupled to a plurality of froth separating containers, and a plurality of valves in pass positions to the pump coupled to a plurality of printing supply containers, in accordance with certain exemplary implementations.

FIG. 5 is similar to FIG. 1, and illustrates that fluid delivery system 140 may configured to provide a plurality of printing fluids to printhead assembly 102. Here, fluid delivery system 140 includes, for a first printing fluid a fluid supply container 104A, a separating container 106A, a double bubbler 108A, a valve 112A, an out of fluid sensor 114A, and various interconnecting fluid passageways 124A, 126A, 128A, 130A, 132A, and 134A. Also associated with the first printing fluid within printhead assembly 102 is a fluid reservoir 142A within which is arranged a pressure regulating mechanism having an inflatable bag 116A biased to deflate by resilient member 120A. Inflatable bag 116A is pressurized by atmospheric gas through a vent 118A.

Similarly, fluid delivery system 140 includes, for a second printing fluid a fluid supply container 104B, a separating container 106B, a double bubbler 108B, a valve 112B, an out of fluid sensor 114B, and various interconnecting fluid passageways 124B, 126B, 128B, 130B, 132B, and 134B. Also associated with the first printing fluid within printhead assembly 102 is a fluid reservoir 142B within which is arranged a accumulator mechanism having an inflatable bag 116B biased to deflate by resilient member 120B. Inflatable bag 116B is pressurized by atmospheric gas through a vent 118B.

Pump 110 is used to urge both the first and second printing fluids, and/or any gas/froth associated therewith. In other implementations, separate pumps may be used for each printing fluid. Although not illustrated in FIG. 5, controller 150 may be shared and coupled as needed to the various components associated with each printing fluid. Further, each printing fluid can be operatively associated with a different subset of the nozzles in printhead 122.

Figure 6:
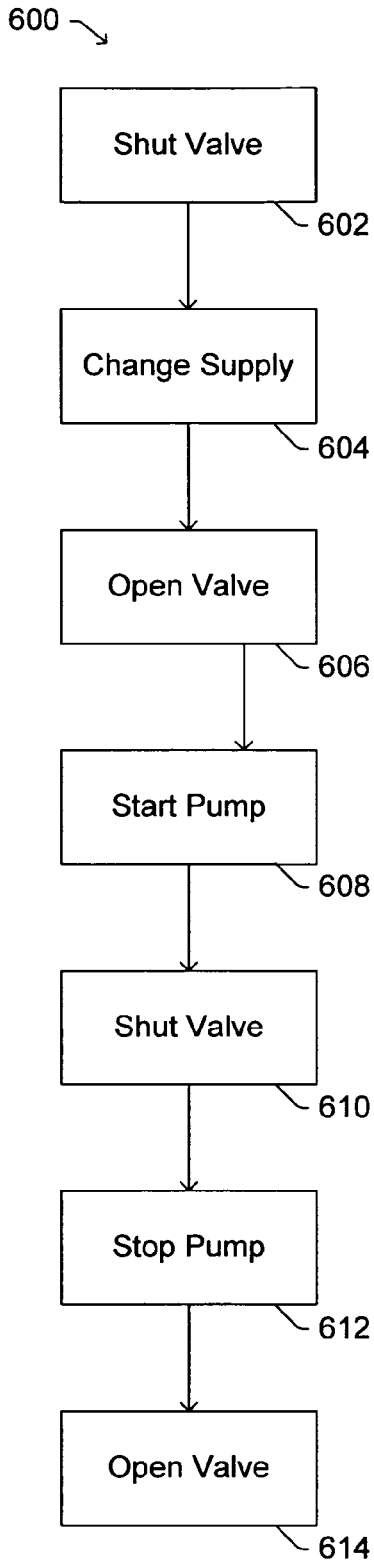
FIG. 6 is a flow diagram illustrating a method for use in a printing device including a free flow fluid delivery system when a printing supply container is initially inserted or otherwise replaced, in accordance with certain exemplary implementations.

FIG. 6 is a flow diagram illustrating an exemplary method 600 for use in printing device 100 including a free flow fluid delivery system 140 when printing supply container 104 is initially inserted or otherwise replaced. Method 600 may also be used to re-circulate fluid and remove gas and/or froth in the process.

In act 602, valve 112 is placed in a shut state to halt the flow of printing fluid from fluid supply container 104 towards fluid reservoir 142. In act 604, the user inserts a new fluid supply container 104 into printing device 100. In act 606, valve 112 is placed in an open state such that the printing fluid in fluid supply container 104 may flow towards fluid reservoir 142. In act 608, pump 110 is started. In act 610, after a specific amount of printing fluid being pumped from fluid supply container 104 and/or a specific period of time has passed since pump 110 was started, valve 112 is placed in a shut state to prevent any further flow of the printing fluid from fluid supply container 104. In act 612, pump 110 is shut.

At this point, as a result of the accumulator mechanism inside fluid reservoir 142, the fluidically coupled elements should be at a lower pressure than the atmosphere. Thus, in act 614 printing fluid from fluid supply container 104 will be drawn towards fluid reservoir 142 once valve 112 is placed in an open state. Eventually, a steady pressure state will be reached within the fluidically coupled elements as the printing fluid flows (e.g., as illustrated in FIG. 3) and gas from the atmosphere enters through double bubbler 108. Note that the steady pressure state will provide the appropriate back pressure. Printing device 100 is now primed and may be used for printing.

Figure 7:
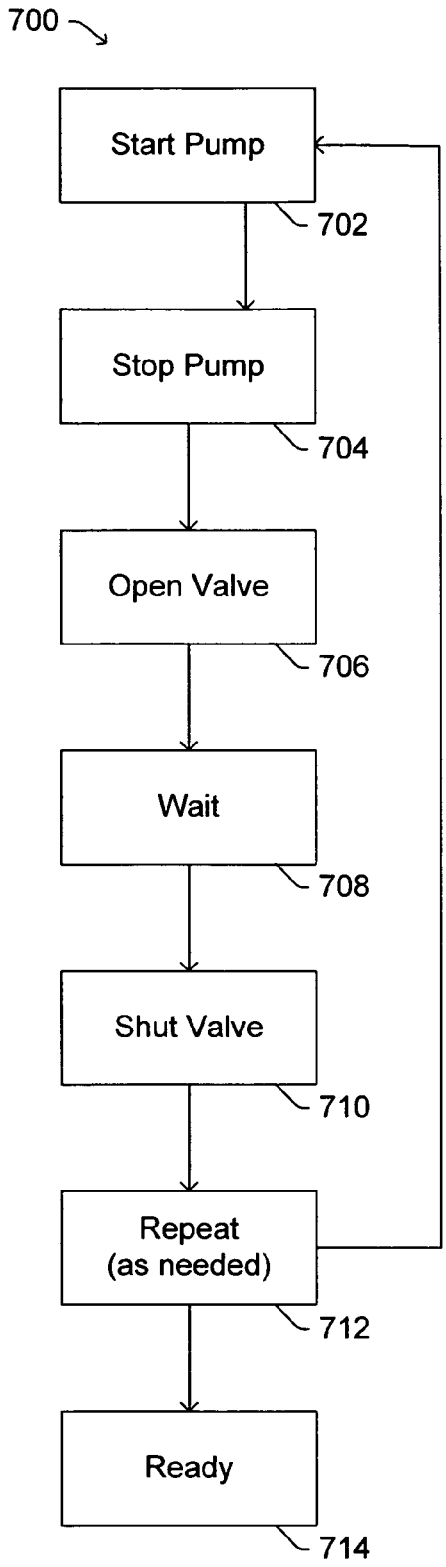
FIG. 7 is a flow diagram illustrating a method for use in a printing device including a free flow fluid delivery system when the printing device is started or restarted, in accordance with certain exemplary implementations.

FIG. 7 is a flow diagram illustrating an exemplary method 700 for use in printing device 100 including a free flow fluid delivery system 140 when printing device 100 is started or restarted, for example, after an extended period of non-use.

In act 702, pump 110 is started to create a slight vacuum in the system, e.g., place the fluidically coupled elements at a lower pressure than the atmosphere. In act 704, pump 110 is stopped after a specific amount of printing fluid has been pumped and/or a specific period of time has passed since pump 110 was started. In act 706, valve 112 is placed in an open state allowing printing fluid from fluid supply container 104 will be drawn towards fluid reservoir 142. In act 708, method 700 waits for a period of time to pass to allow a steady pressure state to be reached within the fluidically coupled elements. In act 710, valve 112 is placed in a shut state. At this point, printing device 100 should now be primed and ready for printing per act 714. However, in certain circumstances it may be appropriate perform act 712 in which acts 702 through 710 are repeated one or more times until printing device 100 is primed and ready for printing per act 714.

Figure 8:
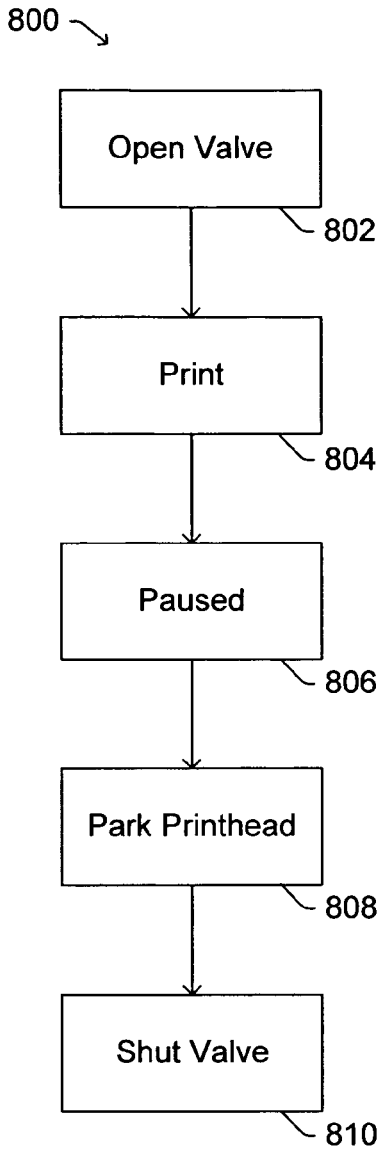
FIG. 8 is a flow diagram illustrating a method for use in a printing device including a free flow fluid delivery system when the printing device is printing, in accordance with certain exemplary implementations.

FIG. 8 is a flow diagram illustrating an exemplary method 800 for use in printing device 100 including a free flow fluid delivery system 140 when the printing device 100 is printing.

In act 802, valve 112 is placed in an open state. In act 804, printhead 122 is operated to eject printing fluid and in doing so causes printing fluid to flow from fluid supply container 104 bay way of valve 112. In act 806, once the printing process has ended, method 800 pauses for a specific periods of time in case another printing process is about to begin. During act 806 a steady state may also achieved. In (optional) act 808, when it has been determined per act 806 that the printing process is complete, then printhead assembly 102 is moved and parked or otherwise placed in an idle appropriate position. In act 810, valve 112 is placed in a shut state.

Figure 9:
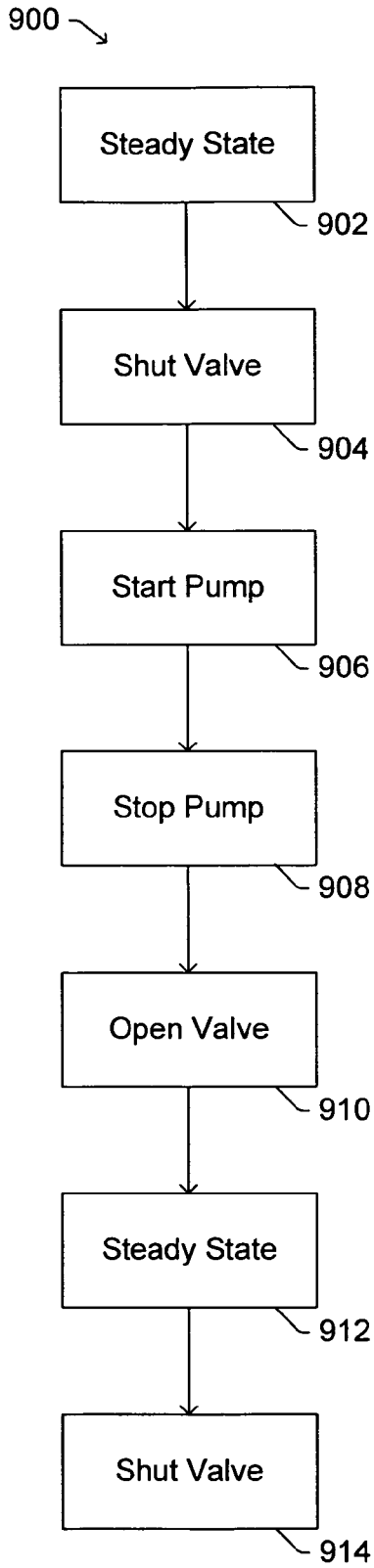
FIG. 9 is a flow diagram illustrating a method for use in a printing device including a free flow fluid delivery system when the printing device is undergoing an air management maintenance process, in accordance with certain exemplary implementations.

FIG. 9 is a flow diagram illustrating an exemplary method 900 for use in printing device 100 including free flow fluid delivery system 140 when printing device 100 is undergoing an air management maintenance process.

Here, the goal is to reduce the amount of air and/or froth in printing device 100. In act 902, method 900 is paused (as needed) to allow a steady pressure state to be reached within the fluidically coupled elements. In act 904, valve 112 is placed in a closed state. In act 906, pump 110 is started. In act 908, pumping stops when a pumped threshold pressure is reached and/or for a specific period of time has passed since pumping started. In certain implementations, act 906 is conducted to extract more than the expected volume of gas that would occupy the fluidically coupled elements. To accomplish this in certain implementations, the accumulator mechanism should be configured to hold a lower than atmospheric pressure without disrupting the meniscus of printing fluid at the nozzles, which might cause air to be drawn into printhead 122 and/or fluid reservoir 142.

In act 910, valve 112 is placed in an open state allowing printing fluid from fluid supply container 104 will be drawn towards fluid reservoir 142. In act 912, method 900 waits for a period of time to pass to allow a steady pressure state to be reached within the fluidically coupled elements. In act 914, method 900 is completed and valve 112 can be placed in a closed state.

Although the above disclosure has been described in language specific to structural/functional features and/or methodological acts, it is to be understood that the appended claims are not limited to the specific features or acts described. Rather, the specific features and acts are exemplary forms of implementing this disclosure.

What is claimed is:

1. A method for use in a printing device, the method comprising:

allowing a printing fluid to flow from a fluid supply container to a fluid reservoir of a printhead assembly; then, urging material from at least said fluid reservoir and said fluid supply container to a separating container; then, preventing any further amount of said printing fluid from flowing from said fluid supply container, while continuing to urge said material from at least said fluid reservoir to said separating container; then, stopping the urging of said material from at least said fluid reservoir to said separating container; and then, allowing said printing fluid to flow from said fluid supply container to said fluid reservoir; and allowing printing fluid inside said separating container to flow into said fluid supply container.

2. The method as recited in claim 1, further comprising:

during all acts of the method, allowing bidirectional gas movement between said separating container and an atmosphere external to said separating container when a pressure difference reaches or exceeds a threshold level.

3. A method for use in a printing device, the method comprising:

coupling a valve to a fluid supply container having printing fluid therein; then, opening said valve to fluidically couple said fluid supply container and a fluid reservoir of a printhead assembly; then, starting a pump configured to urge material from at least said fluid reservoir to a separating container, said pump being fluidically coupled to said valve so as to urge said printing fluid from said fluid supply container through said valve when opened into said separating container; then, shutting said valve to fluidically decouple said fluid supply container from said fluid reservoir and also said pump; then, stopping said pump; and then, reopening said valve to fluidically couple said fluid supply container and said fluid reservoir; and allowing printing fluid inside said separating container to flow into said fluid supply container.

4. The method as recited in claim 3, further comprising:

during all acts of the method, allowing bidirectional gas movement between said separating container and an atmosphere external to said separating container when a pressure difference reaches or exceeds a threshold level.

5. A method for use in a printing device, the method comprising:

running a pump that configured to urge material from at least a fluid reservoir of a printhead assembly to a separating container;

stopping said pump; and then opening a valve to fluidically couple a fluid supply container and said fluid reservoir;

allowing printing fluid inside said separating container to flow into said fluid supply container; and during the running, stopping, opening and allowing, permitting bidirectional gas movement between said separating container and an atmosphere external to said separating container when a pressure difference reaches a threshold level.

6. A method as recited in claim 5, the method comprising:

as part of a printing process, causing a printhead in said printhead assembly to eject at least a portion of said printing fluid in said fluid reservoir.

7. The method as recited in claim 6, further comprising:

determining when said printing process is completed; and then shutting said valve to fluidically decouple said fluid supply container and said fluid reservoir.

8. The method as recited in claim 6, further comprising:

determining when said printing process is completed; and then placing said printhead assembly in an idle appropriate position.

* * * * *